US005934828A

United States Patent [19]

Hu et al.

[11] Patent Number: 5,934,828

[45] Date of Patent: Aug. 10, 1999

[54] DRAINAGE METHOD AND STRAP DRAINING MATERIALS THEREFOR

[75] Inventors: Ming-Chun Hu, Flower; Yao-Kun Hsu, Taipei, both of Taiwan

[73] Assignee: Yung-An Tu, Taipei, Taiwan

[21] Appl. No.: 09/009,315

[22] Filed: Jan. 20, 1998

[30] Foreign Application Priority Data

Feb. 4, 1997 [TW] Taiwan ..... 86101268

[51] Int. Cl.[6] ..... E02B 11/00

[52] U.S. Cl. ..... 405/43; 405/36; 405/45; 52/169.5; 52/169.14

[58] Field of Search ..... 405/36, 43, 45, 405/50; 52/169.14, 169.5, 302.1

[56] References Cited

U.S. PATENT DOCUMENTS

| | | | |
|---|---|---|---|
| 3,563,038 | 2/1971 | Healy et al. | 405/45 |
| 3,830,067 | 8/1974 | Osborn et al. | 405/45 |
| 3,936,380 | 2/1976 | Boske | 405/45 X |
| 4,246,305 | 1/1981 | Delattre | 405/50 X |
| 4,622,138 | 11/1986 | Wager | 405/50 X |
| 4,815,892 | 3/1989 | Martin | 405/50 X |
| 5,056,281 | 10/1991 | McCarthy | 52/169.5 |
| 5,369,926 | 12/1994 | Borland | 52/302.1 |
| 5,511,346 | 4/1996 | Kenworthy | 405/45 X |
| 5,688,073 | 11/1997 | Brodeur et al. | 405/50 X |
| 5,704,172 | 1/1998 | Gougeon et al. | 52/169.14 X |
| 5,780,144 | 7/1998 | Bradley | 405/50 X |

FOREIGN PATENT DOCUMENTS

| | | | |
|---|---|---|---|
| 58618 | 2/1990 | Japan | 405/43 |

*Primary Examiner*—David J. Bagnell
*Assistant Examiner*—Jong-Suk Lee
*Attorney, Agent, or Firm*—Burns, Doane, Swecker & Mathis, L.L.P.

[57] ABSTRACT

A strap drain material includes a strap having at least a first and a second side and a first and a second end. At least the first side of the material has a plurality of slots arranged in a spaced-apart fashion along a width of the strap and extending along a length of the strap, and a plurality of notches, each of the plurality of notches corresponding to each of the plurality of slots extending from the slots to a surface of the strap. Each notch is sized such that the notch is capable of creating a capillary action and is adapted to draw liquid from outside of the strap and into the slot corresponding to the notch.

11 Claims, 4 Drawing Sheets

DRAINAGE METHOD AND STRAP DRAINING MATERIALS THEREFOR

BACKGROUND OF THE INVENTION

The present invention relates to a novel drainage method and the strap draining materials therefor and, in particular, to a draining method adapted for use in drainage system in the soil conservation on mountain slopes, agricultural industry and in civil engineering work and to flexible thin sheet like draining straps having a high resistance to pressure and a high efficiency of drain absorption.

Conventionally, the most frequent use of water permeable and draining materials in drainage in the soil conservation on mountain slopes, underground irrigation and drainage on farms, and the civil engineering work on tunnel road bases and retaining walls are of a tubular type, that is, the so-called permeability pipes or drain pipes. The basic structure of a drain pipe is all that the circumference of at least of more than a half of the upper half portion of the circular tubular pipe is opened up with numerous tiny cracks densely distributed like meshes of a net for collecting infiltration water from the soil cover into the non-porous water collecting part of the lower half portion in the pipe and from there again water to flow out along the longitudinal direction of the pipe. However, because the infiltration water moves water to flow downwardly into the lower half portion of the pipe by the water head and the water gravity, it must also carry along the tiny sandy particles into the meshes. Certainly, the sandy particles after collecting for some time gradually seal the meshes resulting thus in a blockade. Even though a part of the sandy particles entering the pipe can be discharged together with the water that has infiltrated into the pipe, because the amount of water collecting in the pipe is small and the speed of drain flow is low, a majority of sandy particles will settle on the lower half portion of the pipe. When collecting over a long period, it also results in disadvantages that there is blockade in the pipe and reduction in the amount of drain. Sometimes, to prevent blocking of the meshes, there is covered on the outside of the drain pipe with a non-woven coating or a synthetic fiber gauze as the filtering layer thereby forming a multiple-layer permeability pipe or drain pipe.

However, since after use over a period of such a filtering layer blockade can still occur, its use would merely accomplish the effect of prolonging the life only. Furthermore, as drain pipes of the kind are mostly made of a hard plastics, this makes the construction process on embedding relatively inconvenient. Again, as the total area of the meshes provided on the unit area of the circumference of the drain pipe to act as the water inlet hole differs greatly from the pipe diameter sectional area (water service sectional area) and the actual amount of drainage in the drain pipes is less than one third of its sectional area, no siphonic action will thus be created. On the other hand, if the circumference of the pipe is formed densely with meshes, there will be a great reduction in the resistance to pressure in the drain pipe and the pipe can hardly be resistant to the soil pressure and the heavy pressure from vehicles, the drain pipe will get distorted easily and will even break by pressure leading to a blockade in the meshes or the pipe.

In order that the drain pipe be flexible and bendable to facilitate construction, a soft flexible permeable pipe made of various materials of PVC coated screw-type spring steel wire, non-woven fabric tube and nylon yarn has also been disclosed. However, even with such a flexible permeable pipe the problems of the aforesaid blockade in the meshes and the resistance to pressure still remain.

Others also include disclosure of forming a screw ditch on the outer circumference of a hard plastic drain pipe and in which the meshes are provided inside the ditch whereby it enhances the strength of the pipe body and improves the absorption efficiency.

There is disclosed also another type of a non-tubular type of drain sheet. This type of drain strap is formed by coating on the surface of a hard plastics formed concavo-convex support body with a layer of felt non-woven fabric. The support body also has the two sides formed in ditches, however, the opening of the ditches is broader than the ditch bottom.

It is the purpose of the present invention to provide a new draining material which differs in construction, shape and principle from the foregoing various drain pipes and sheets, and which possesses a large drainage of high absorption rate, a resistance to pressure and is without a blockade and further is adapted for use in all kinds of drainage system.

SUMMARY OF THE INVENTION

An object of the present invention is to provide a drainage method whereby the capillary action produced at the narrow crack notches of the small diameter drain collecting slots extending longitudinally and provided densely on the surface of the thin strap draining materials embedded within the soil cover is used to absorb water contained in the soil cover into the slots and whereby the siphonic force produced by the drop of water level at the two ends or any one section of the slots is used to enhance absorption and collect and discharge water from one end of the slots.

A further object of the present invention is to provide a drainage method, wherein notches of the drain collecting slots of the draining materials face downwardly, water not only enters the slots by the capillary action on the one hand, the surface tension of water produced at the narrow notches is used to support the water pressure in the slots and not to leak back on the other hand, at the same time the siphoning force produced at the section of drop is used to collect and discharge water, and because of the notches facing downwardly, it is possible to effectively prevent the drawback that the sand particles sink because of gravity and collect at and blockade the slots.

A yet another object of the present invention is to provide a drainage method, whereby a strap draining material having on one side densely provided with small hole diameter drain collecting slots extending whole length along the longitudinal direction and having the notches being capable of producing capillary action is embedded between the soil cover or stratum and the wall of a permeable structure such that the side with the drain collecting slots is closely joined to the soil cover or the stratum while on the other hand the side, which is without drain collecting slots, is closely joined to the wall of the structure, and characterized in that water content from the soil is suctioned through the notches into the slots by the capillary action and the water inside the slots is collected and discharged by the siphoning force created by the drop of water level at the two ends of the slots while at the same time, by the side, which is without drain collecting slots, water from the soil is blocked from permeating into the wall of the structure.

An additional object of the present invention is to provide a strap draining material capable of effectively implementing the above method, in which the strap draining material is formed of a weather-resistant, thermoplastic synthetic resin into a thin sheet elongated strap body, at least one side thereof having a plurality of tiny drain collecting slots densely arranged spaced-apart along the direction of the breadth of the strap and extending whole length of the strap in the direction of the strap length, the notches thereof forming narrow cracks enough to create a capillary action and inside the slots there being formed of ditches in section of expanded small round holes to facilitate collection and discharge of the water that is absorbed into the slots.

A yet different object of the present invention is to provide a strap draining material which can be used as a waterproof membrane as well as a draining material in the basement and tunnel constructions.

A further object of the present invention is to provide a strap draining material, the side of which where there is without drain collecting slots is still formed in an even and smooth surface or a plain surface having a plurality of reinforced ribs.

A still further object of the present invention is to provide a strap draining material where the side of which is formed in a plain surface is attached with a reinforcement member for enhancing the resistance to soil pressure and the form maintaining . Another object of the present invention is to provide a draining strap where the side of which has slots is struck with a non-woven filter material.

A further object of the present invention is to provide a draining material, which is easy and simple to use and which requires less space for storage and transportation of the materials and has a wide application of uses and can be used for a long duration.

BRIEF DESCRIPTION OF THE DRAWINGS

Other objects, features and advantages of the invention will be apparent from the following more particular description of a preferred embodiment of the invention, as illustrated in the accompanying drawings.

DETAILED DESCRIPTION OF THE INVENTION

Figure 1:
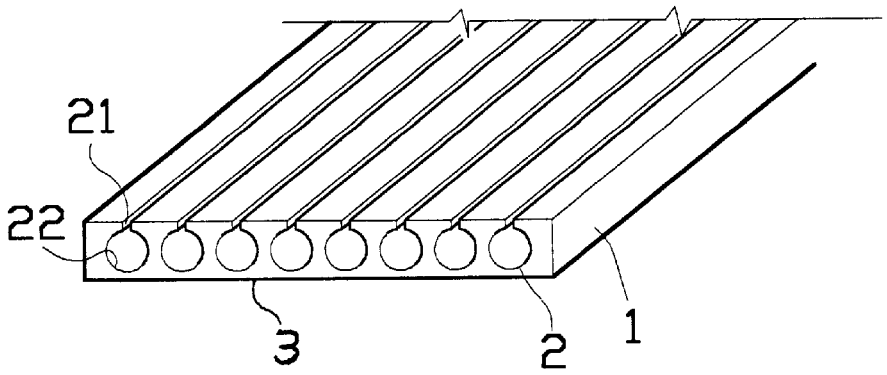
FIG. 1 is a perspective view showing a first embodiment of the draining material of the present invention.

FIG. 1 is a perspective view of one embodiment of the draining material of the present invention, with a section cut off along the direction of its length, in which the numeral 1 represents the elongated strap draining material with a flat shape in section. This draining material 1 is a flexible strap body made by forming of a weather-resistant thermoplastic synthetic resin, one side of which is provided with a plurality of tiny drain collecting slots 2 densely arranged spaced-apart along the direction of breadth and parallel extending whole length along the longitudinal direction. Notches 21 of the slots 2 are formed in narrow cracks sufficient to create a capillary action and are communicated inwardly with small round hole slots 22 with an expanded section. The other side of the strap body is formed in a flat and smooth surface 3. In this manner, the entire strap body is formed in a strap of reel band having the two sides both actually of a plain surface capable of being rolled up like a bolt of cloth and cut in appropriate length for use according to need. The notches 21 are formed in inlet portions to absorb water by capillary phenomenon while the slots 22 are formed in channels for collecting and draining water, the action and principle of which will be described hereinbelow.

Figure 2:
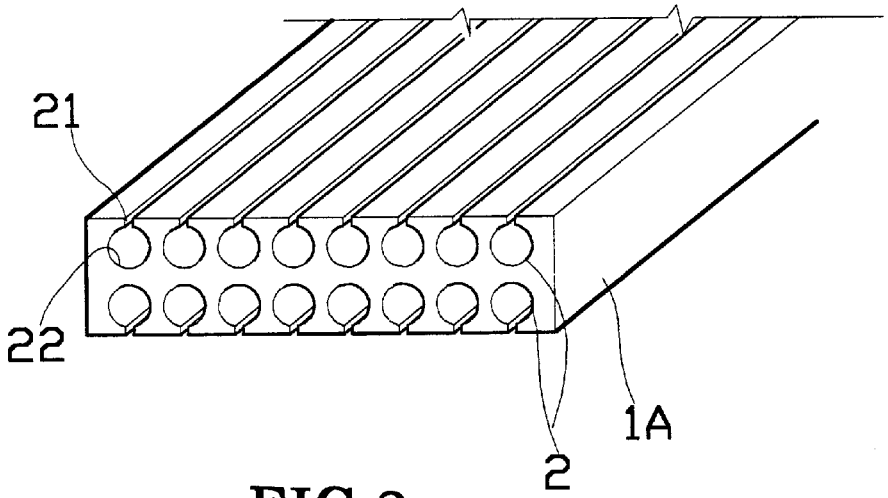
FIG. 2 is a perspective view showing a second embodiment of the draining material of the present invention.

FIG. 2 is a second embodiment of the draining material of the present invention, in which a draining material 1A is basically same as the first embodiment of a flat elongated strap body made by forming of a thermoplastic synthetic resin. However, both the upper and lower sides of the strap body are formed with drain collecting slots 2 of same construction as the first embodiment. In the present embodiment, the drain collecting slots 2 on the two sides of the draining strap IA are maintained on the same pitch and opposite to each other vertically. However, it is also possible if a vertically staggered arrangement is followed.

Figure 3:
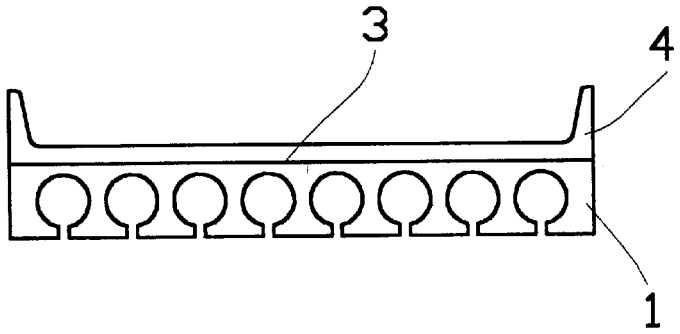
FIG. 3 is a perspective view showing a third embodiment of the draining material of the present invention.
Figure 4:
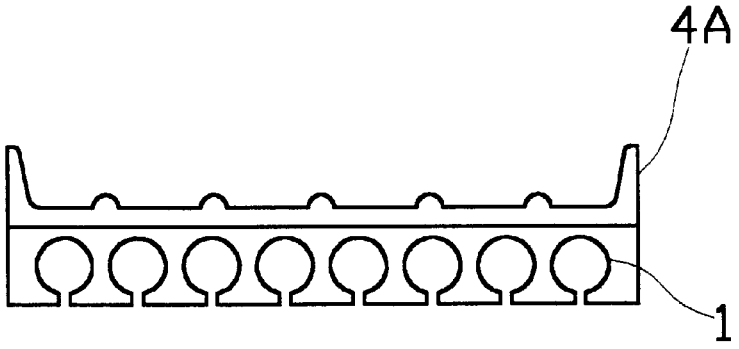
FIGS. 4(A), (B) and (C) are front views showing the deformation examples of the draining material attached with a reinforcement material.
Figure 4:
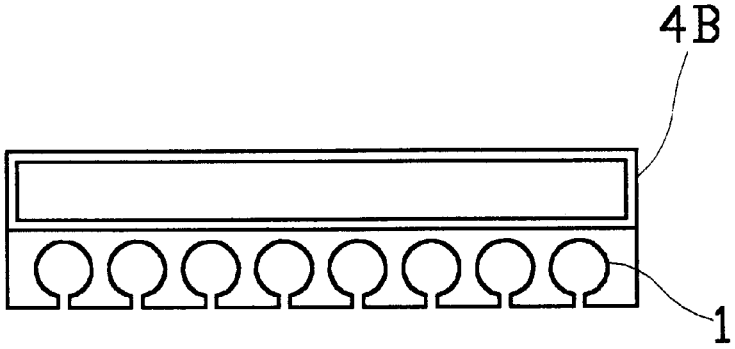
Figure 4:
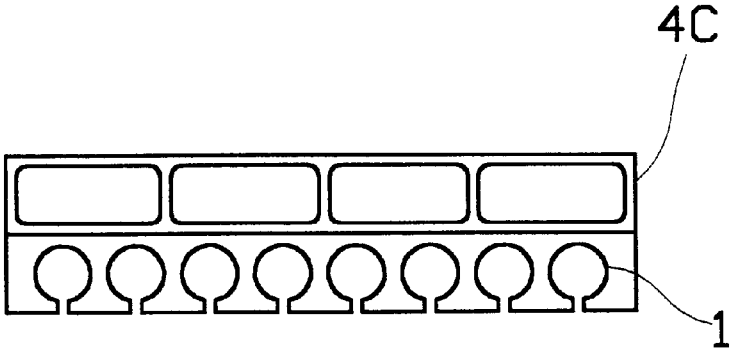

FIG. 3 is a third embodiment of the draining material of the present invention, where in order to enable the soft flexible draining material to have a high strength of resistance to soil pressure, there is attached to the flat and smooth surface 3 of the draining material 1 shown in FIG. 1 a reinforcement material 4 formed of a hard plastic material. In the present embodiment, the form material 4 uses simply a U-shaped material, however, it is also possible to use, for example, a U-shaped material 4A containing inside the slot numerous ribs, or a formed pipe material 4B or any other suitable form material 4C, as shown in FIGS. 4(A), (B) and (C).

Figure 5:
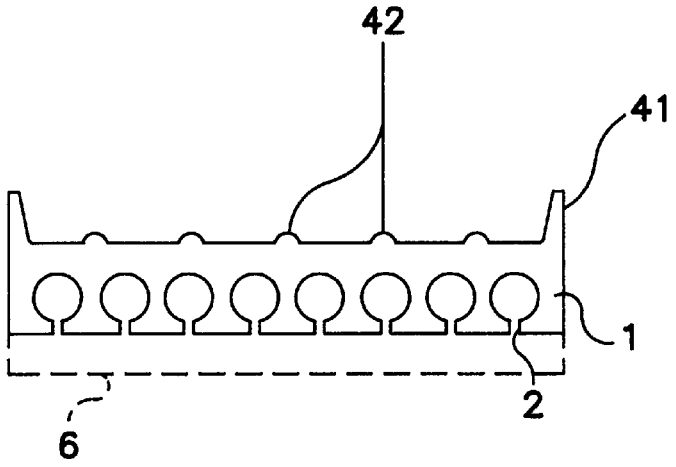
FIG. 5 is a front view showing a fourth embodiment of the draining material of the present invention.

FIG. 5 is a further embodiment of the draining material of the present invention, whereas in the third embodiment one side of the draining material 1 is attached with a hard plastics made reinforcement form material 4 in the present embodiment, however, the reinforcement portion is formed directly integrally with the draining material 1. The reinforcement portion shown in the drawings includes several high and low ribs 41, 42 extending along the longitudinal length, it is apparent however that various modifications can be made. Next, on the one side of the foregoing draining strap 1 having drain collecting slots 2, if necessary, there may be coated also with a non-woven and nylon yarn as filter material 6 (shown in phantom by dotted lines).

EXAMPLE 1

Figure 6:
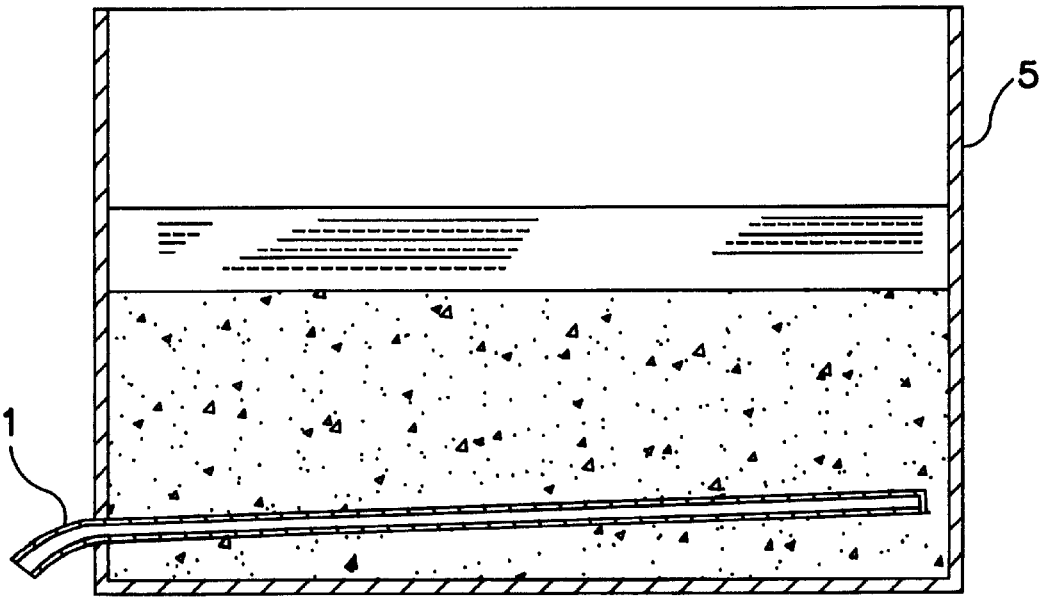
FIG. 6 is a schematic view showing the apparatus of Examples 1 and 2 of the draining material of the present invention.

A strip of the draining strap 1 of the first embodiment having length 35 cm×width 5 cm×thickness 0.3 cm with a pitch of holes 1.2 mm on one side thereof and a total of 40 lanes of drain collecting slots 2 with notches 21 of a breadth 0.15 mm and slots 22 of a diameter 0.9 mm was obtained. With the side with slots facing upwardly and the inner end higher than the outer end for about 1 cm, the draining strap 1 after the inner end was sealed, was embedded on the bottom inside an acryl transparent plastics made container 5 of width 30 cm×length 30 cm×height 20 cm such that the outer end of the draining strap was exposed to the outside for about 6 cm as shown in FIG. 6. Sandy soil of mud and river sand mixed in a ratio of 2:1 and slightly pressed to be flat and smooth was filled into the container 5 to a height of 15 cm with a remaining height of 5 cm on the soil surface. This remaining height of 5 cm on the soil surface was filled with water 30×30×5=4500 cc and after two minutes (depending upon the rate of water permeation in the mud), water flowed out from the outlet end of the draining strap.

Based on observation of the outflow of water, it has been found that water flows out from about ⅔ of the slots and the state of water flow appears to be in a continuous or intermittent water column of full slots. This indicates that owing to differences in density and rate of water permeation among various parts in the nature of the soil, water absorbed through the notches by the capillary phenomenon enters the slots one after the other and partially to be collected to form a segment of water column for discharge. At this time when water column flows towards the outlet end via a drop in the water head, a vacuum suction effect is created in the rear part thereof which again brings another segment of water segment of water column of the collected water at the rear part to move forward so that a siphonic action is produced. By means of this siphonic action, water that enters the slots is continuously sucked out thereby improving further the capillary action to accomplish a high rate of water absorption and rate of drainage. That about ⅓ of the slots where there is only a small amount that flows out and the flow stops or there is no water to flow out, it is because the force of infiltration from the upper layer of the soil into the lower layer is not sufficient for absorption and drainage in all of the slot ways of the present draining strap. In other words, because the draining strap has an excellent rate of water absorption, use of only those draining straps having 25 to 30 lanes of drain collecting slots proves to be more than enough with respect to the sandy soil and the amount of water use in the present experiment.

EXAMPLE 2

The draining strap 1 of Example 1 was embedded with the reverse side thereof, that is, the side having slots 2, facing downwardly in the similar position of the container 5, and the other conditions were same as in Example 1. The container was filled with water 4500 cc and then after approximately 2 minutes and 5 seconds had passed, water flowed out from the outlet end of the draining strap. Same as in Example 1, the flow was still in the form of continuous or intermittent water column flowing out from about ⅔ of the slots 2 on the straps. To observe that the state of outflow of water is more continuous than the state in Example 1 and the rate of flow is faster, this can be seen from the fact that when outflow of water started till the container was filled to the capacity of 500 cc and 1000 cc respectively, the time t2 needed in Example 2 was shorter by a little of several of ten seconds to a few minutes than the time t1 needed in Example 1. It can be deduced that when the reverse side of the draining strap is used, as the upper part of the slots is closed, there is thus no communication with the air from the clearances of the sandy soil to acquire a better effect of siphonic action.

EXAMPLE 3

Figure 7:
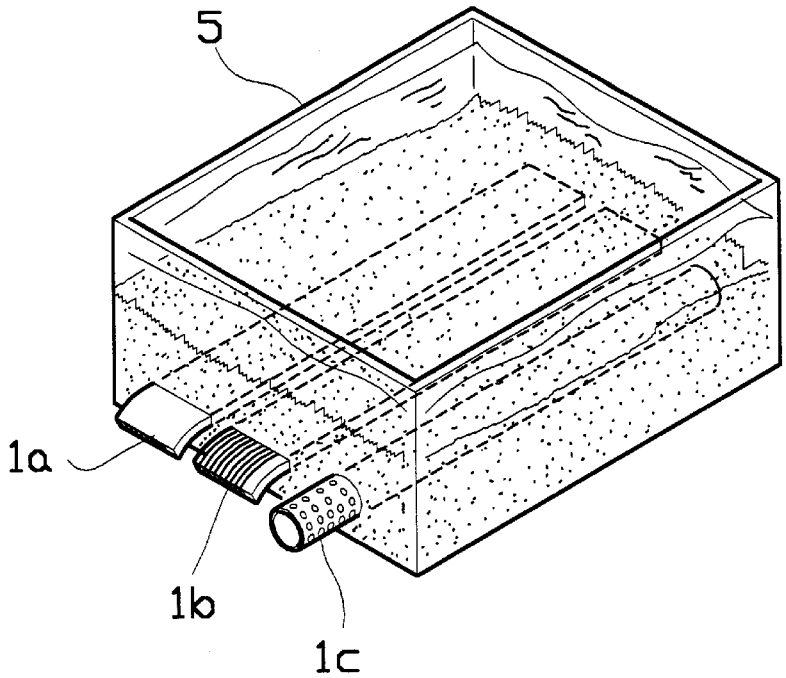
FIG. 7 is a schematic view showing the apparatus of Example 3 of the draining material of the present invention.

Two strips 1*a*, 1*b* and a section of conventional drain pipe 1*c* (diameter 2 cm×length 32 cm) were prepared from the draining strap 1 of Example 1. ⅔ circumferential surface of the drain pipe was provided with numerous small holes and the area of water infiltration was 70 $cm^2$/m. Both strips of the draining strap and the drain pipe were embedded by the same inclination (1/30) in the aforesaid container 5, as shown in FIG. 7, with the draining strap 1*a* facing downwardly, the draining strap 1*b* facing upwardly and the drain pipe 1*c* with the non-porous part lying below. About 2 minutes after addition of water to the full, water flowed out respectively from the draining straps 1*a*, 1*b* and the drain pipe 1*c*. Rate of flow was observed, it flows more rapidly in the draining straps 1*a*, 1*b* than the drain pipe 1*c*. When 2 minutes after the outflow of water started, the outflow of water in the drain pipe 1*c* decreases gradually to 3 ½ minutes the flow of water stops. While the same outflow of water is still maintained in the draining straps 1*a*, 1*b*, however, after 3 ½ minutes the amount of outflow of water also decreases gradually form the draining strap 1*b* till 4 ½ minutes the outflow of water stops. Outflow of water continues in the draining strap 1*a* till after about 30 minutes when it stops. At this time, the sandy soil was substantially saturated with water content and the water level was no longer there on the upper part of the soil.

From the foregoing result of experiments it can be seen that the draining strap of the present invention possesses a strong rate of water absorption and a drainage effect. Accordingly, when water head pressure drops gradually there is a tendency that Infiltration water from the sandy soil infiltrates and flows gradually towards the draining straps 1*a*, 1*b*, especially towards the side of the draining strap 1*a* that faces downwardly. It can be deduced that because the rate of water absorption in the conventional drain pipe is relatively low, the infiltration water infiltrates and flows naturally towards the draining straps where the rate of water absorption is high because of the capillary and siphonic actions, and thus causes the particle clearances in soil for infiltration and flow of the water to gradually form into waterways for the infiltration water to be readily led to the draining straps. Once such waterways are formed, most of the infiltration water will flow towards the ways thereby reducing the water head pressure, the drain pipe 1*c* where absorption effect is low will stop draining, and following this will then be the draining strap 1*b* and the draining strap 1*a* will be the last only.

Figure 8:
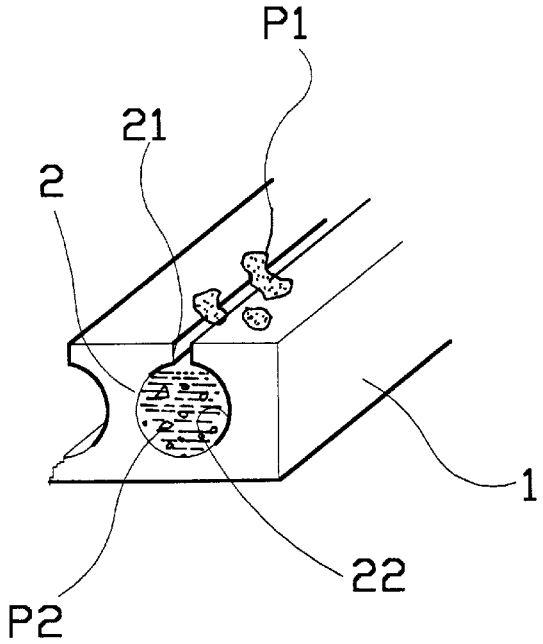
FIGS. 8(A) and (B) sow respectively the partial enlarged views of the draining material with slot portions facing upwardly and downwardly illustrating the principle of drain absorption.
Figure 8:
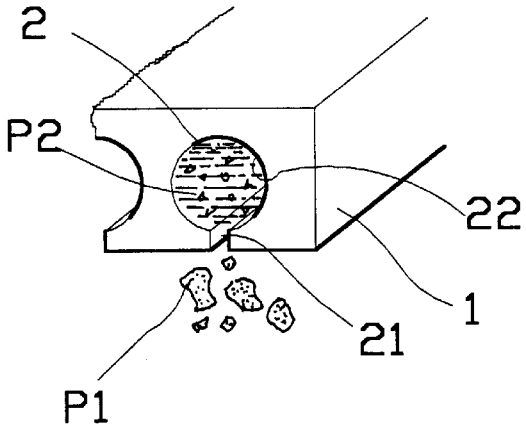

It has been surprisingly found that the draining straps 1*a*, 1*b* of the present invention are better in the water absorption effect than the conventional drain pipes, and then of the same draining straps 1*a*, 1*b* those facing downwardly contrarily are better in the rate of water absorption than those which face upwardly. This will be described in more detail in the following by means of partially enlarged drawings of FIGS. 8(A) and 8(B). As shown in FIG. 8(A), because the notches 21 of the drain collecting slots 2 face upwardly, inevitably the sandy loam P1 of larger particle size gradually collects on the upper part of the notches 21 causing a partial blockade in the notches. However, since the notches extend longitudinally, unlike the general drain pipes which have individual meshes of a considerable pitch and can be easily blocked, here there are still intercommunicating notches of a considerable length or number that can absorb infiltration water by the capillary action and at the same time encourage drainage by the siphonic action created inside the slots. The result is a much better drain absorption effect than is in a drain pipe that relies merely on the water head and the gravity of water for water flowing in and drainage. Moreover, the sandy loam P2 that enter the slots 22 from the narrow notches 21 will not block either because there the space increases abruptly and also because of the siphonic action created in the notches the sandy loam easily flows out with water.

FIG. 8(B) shows the notches 21 facing downwardly and in the condition, water flows in by the water-head pressure and the capillary effect. Since the draining strap 1 is closed on the above and also the notches 21 face downwardly, both large and small size sandy loam particles P1, P2 settle down because of the gravity and will not collect and enter the notches and block in. Only the dissolved matter enters the slots 22 and this matter dissolves in and flows out with water. Next, because the notches are very narrow, it is sufficient to support water pressure inside the slots by means of the surface tension in the stationary state and there is no back leakage. Also, as it is closed on the top surface and air can hardly come in, a vacuum state is more readily produced, which resulted in the interior of the slots by the siphonic action, the efficiencies of water absorption and drainage, to the contrary, are better than those whose notches face upwardly. In addition, because of the dissolved matter which is drained away uninterruptedly along with the water, it results in the crevices between the sandy loam particles to become larger thereby increasing further the rate of water infiltration in the sandy loam and also results in water mark defects or infiltration routes for water to be collected readily towards the draining straps thereby further raising the efficiency of drainage. Same experiments were performed under different conditions of soil and water volume, and at conditions with different known drain pipes, and similar results were obtained, which indicates that the draining straps or bands of the present invention is superior over the conventional drain pipes and that the straps with notches than those will are better than those with notches facing upwardly or facing any of other directions.

Furthermore, when water content in the sandy loam has reached saturation and the draining strap has stopped draining, water drains away again when pressure is exerted on the sandy loam and whereby the humidity in the sandy loam drops and the hardness increases. If instead vibration is exerted, the conditions will also be the same.

From the foregoing, it is clear that the drain materials of the present invention not only use the capillary action plus siphonic action in achieving a high effectiveness of water absorption and drainage, but because also the straps are formed in a flexible flat band-like structure to facilitate transportation and construction and resistance to pressure, permit gravity rolling at the condition of only a thin soil cover or without a soil cover thus making it possible a saving in the cost of construction. Also, in the above condition where the soil is saturated with water content, this soil will become liquefied and form mire if subject to gravitational pressure or rolling pressure (such as: by vehicles, etc.). However, using the present drain materials it is still possible to continue draining and to allow the soil to become hardened at once. The materials are therefore advantageous to construction. Besides, since the drain materials are formed of an totally impermeable plastics, they can be used as a waterproof membrane as well as a draining strap to achieve the dual purposes of preventing water from infiltrating into the inner sides of the walls of the construction while simultaneously draining away water from the soil, if the materials are attached by the flat and smooth side thereof to the side of the walls of the basement or tunnel construction which are in contact with the soil by an adhesive.

The materials are thus a novel and extensively useful drain material for use in the drainage system of the agricultural and industrial constructions.

While preferred embodiments of the invention have been shown and described, it will be apparent to those skilled in the art that changes can be made in this embodiment without departing from the principles and spirit of the invention, the scope of which is defined in the appended claims.

We claim:

1. A drainage method, comprising the steps of:

absorbing, by capillary action, liquid from soil in a plurality of drain collecting slots provided on at least one surface of a strap drain material embedded in the soil, the slots including a plurality of notches in the surface of the drain material that are sufficiently small to create a capillary effect and that extend to the slots larger than the notches, the slots extending along a longitudinal direction of the drain material from a first point to a second point of the drain material.

2. The drainage method as set forth in claim 1, wherein the drain material includes the notches on only one side, the method comprising the further step of orienting the drain material in the soil such that the side of the drain material having the notches faces downwardly.

3. The drainage method as set forth in claim 1, wherein the drain material includes the notches on only one side, the method comprising the further step of arranging the drain material adjacent to construction in the soil such that a side of the drain material with the notches faces the soil and the side of the drain material without the notches faces and is substantially adjacent to the construction.

4. The method according to claim 1, comprising the further step of orienting the drain material such that the first point is higher than the second point and such that a siphonic force is created by a drop in water level from the first point to the second point and causes further absorption of water from the soil.

5. A strap drain material comprising a strap having at least a first and a second side and a first and a second end, at least the first side of the strap having a plurality of slots arranged in a spaced-apart fashion along a width of the strap and extending along a length of the strap, and a plurality of notches, each of the plurality of notches corresponding to each of the plurality of slots, the notches extending from the slots to a surface of the strap, each notch being sized such that the notch is capable of creating a capillary action and is adapted to draw liquid from outside of the strap and into the slot corresponding to the notch.

6. The strap drain material according to claim 5, wherein the strap includes a flat and smooth surface on the second side.

7. The strap drain material according to claim 5, wherein the second side of the strap includes a plurality of reinforcing ribs arranged spaced-apart and extending along the length of the strap.

8. The strap drain material according to claim 5, wherein the second side of the strap includes at least one U-shaped reinforcing member.

9. The strap drain material according to claim 5, wherein the second side of the strap includes at least one rectangular pipe member.

10. The strap drain material according to claim 5, wherein the strap is flexible.

11. The strap drain material according to claim 5, further comprising non-woven fiber material on the surface to which the notches extend.

* * * * *